US005215392A

United States Patent [19]

Tobita et al.

[11] Patent Number: 5,215,392

[45] Date of Patent: Jun. 1, 1993

[54] DOT LINE PRINTER WITH PAPER SLACK ELIMINATION MECHANISM

[75] Inventors: Satoru Tobita; Yoshikane Matsumoto; Youichi Hujita, all of Katsuta, Japan

[73] Assignee: Hitachi Koki Co., Ltd., Tokyo, Japan

[21] Appl. No.: 704,246

[22] Filed: May 22, 1991

[30] Foreign Application Priority Data

May 25, 1990 [JP] Japan ..... 2-135762

[51] Int. Cl.[5] ..... B41J 15/16

[52] U.S. Cl. ..... 400/618; 400/636; 400/649; 226/49

[58] Field of Search ..... 400/618, 619, 641, 579, 400/636, 649; 226/49; 242/75.3

[56] References Cited

U.S. PATENT DOCUMENTS 4,896,980 1/1990 Sanders, Jr. et al. ..... 400/618

FOREIGN PATENT DOCUMENTS 166947 1/1986 European Pat. Off. ..... 400/641

148784 9/1983 Japan ..... 400/618

159084 8/1985 Japan ..... 400/618

OTHER PUBLICATIONS

IBM Technical Disclosure Bulletin vol. 22, No. 7 Dec. 1979.

*Primary Examiner*—Edgar S. Burr

*Assistant Examiner*—Stephen R. Funk

*Attorney, Agent, or Firm*—Sughrue, Mion, Zinn, Macpeak & Seas

[57] ABSTRACT

In a dot matrix line printer, a pair of pin tractors for feeding a print paper are operatively connected to a paper feed motor, and a tension roller mechanism disposed beneath a platen is operatively connected to a separately provided drive motor. To eliminate a paper slack which may occur when the feeding of the print paper is stopped after creating many blank lines, the drive motor is energized for a short period of time immediately before the paper feeding is ended. The tension roller mechanism which is made up of a plurality of rollers pulls the print paper in a direction opposite the paper feeding direction to thus prevent the print paper from slackening.

4 Claims, 6 Drawing Sheets

FIG. 2
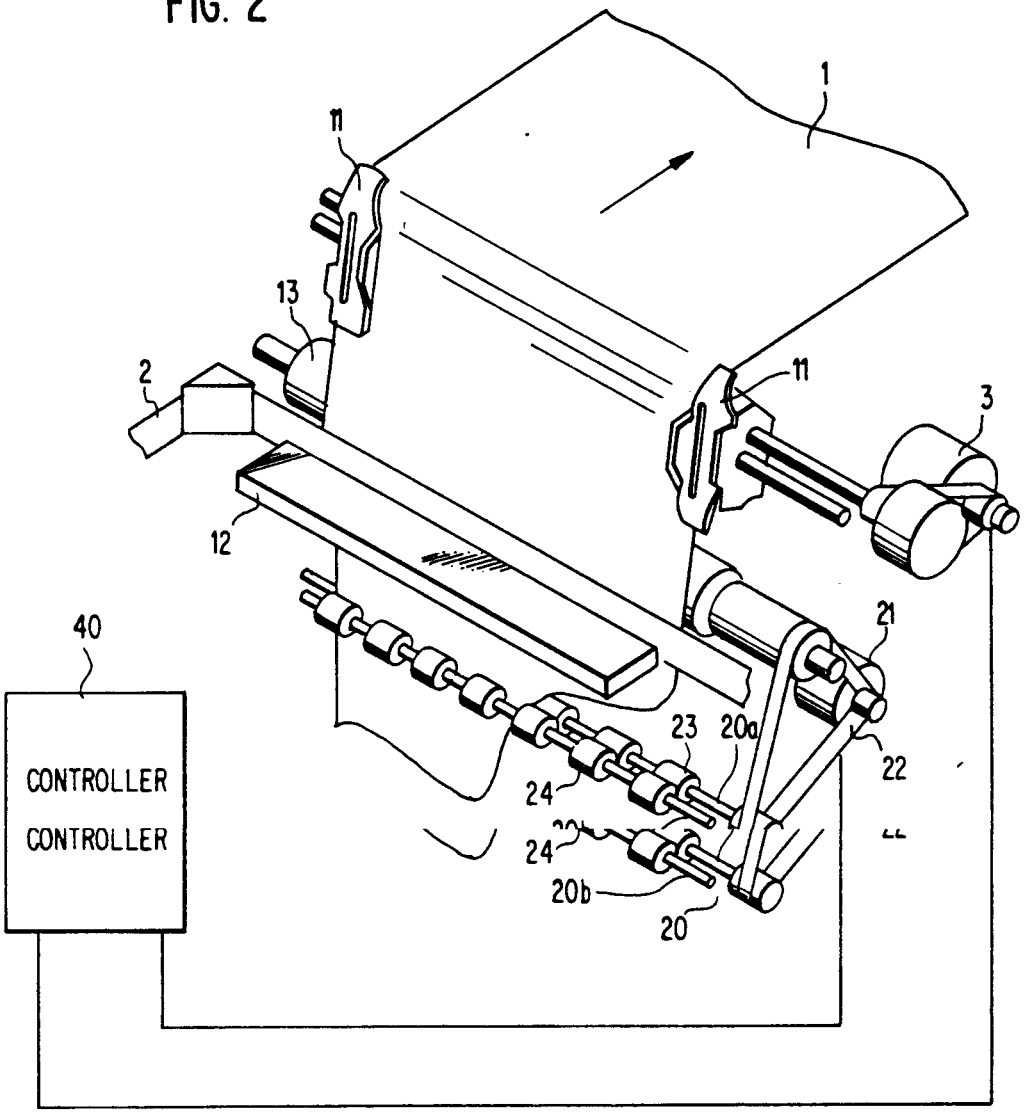
FIG. 3A
PAPER FEED MOTOR
FIG. 3B
DRIVE MOTOR
FIG. 3C
PRINT HAMMER
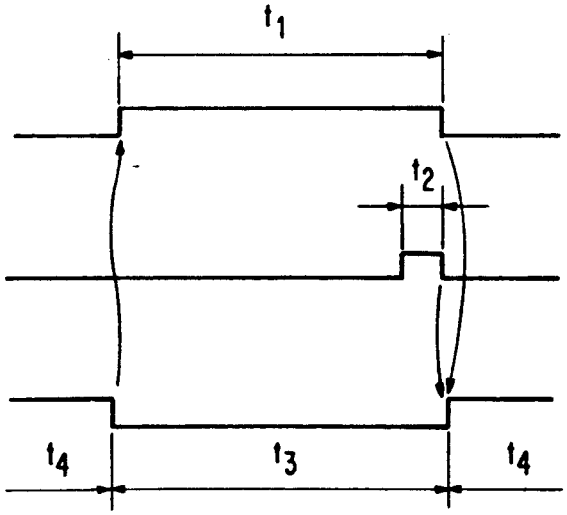

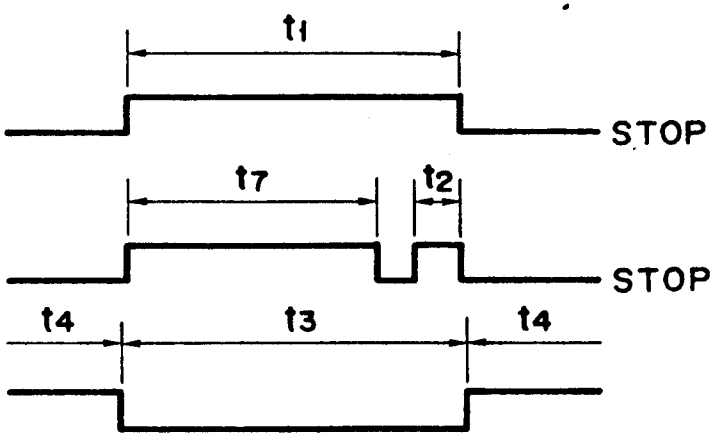
FIG. 4A
FIG. 4B
FIG. 4C
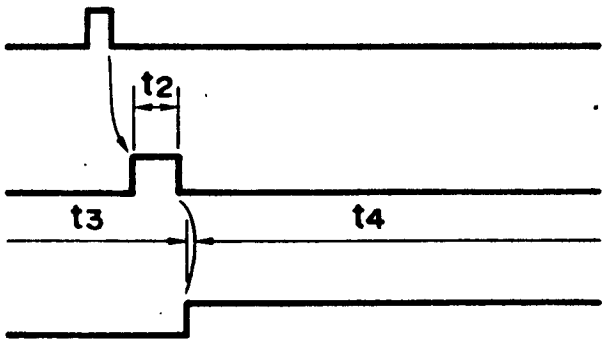
FIG. 5A
FIG. 5B
FIG. 5C

DOT LINE PRINTER WITH PAPER SLACK ELIMINATION MECHANISM

BACKGROUND OF THE INVENTION

The present invention relates to a dot matrix line printer having the capability of eliminating slack in sheets of print paper.

FIG. 1 shows an arrangement of a prior art dot line printer. A hammer bank 12, accommodating a plurality of print hammers (not shown) therein, is reciprocated in the direction perpendicular to a sheet feeding direction. The print hammers are selectively fired during the reciprocal movement of the hammer bank 12 so as to make dot impressions on a continuous form print paper 1 through an ink ribbon 2. Those dot impressions collectively form a dot matrix character or symbol. A platen 13 is disposed rearwardly of the hammer bank 12 with a certain spacing therebetween. The print paper 1 is provided with uniformly-spaced perforations at its side margins, which are drivingly engaged by a pair of pin tractors 11 which entrain the print paper 1. The print paper 1 is moved incrementally past the space between the hammer bank 12 and the platen 13 while being guided by paper guide members 14. The pin tractors 11 and the platen 13 are synchronously driven by a paper feed motor 3 through timing belts 15, 16 and cooperatively feed the print paper 1 on a dot line basis. To prevent the print paper 1 from rippling on the platen at the time of paper feeding, there are provided an elongated friction plate 17 and a paper braking mechanism 18. The friction plate 17 is disposed closely to the peripheral surface of the platen. The paper braking mechanism 18 is disposed at a position beneath the platen 13.

When many blank lines are created at a time after printing several lines, such as the case for renewing a page, the print paper 1 tends to overrun due to an accelerated movement of the print paper 1, thereby yielding a slack of the print paper 1 at a portion between the pin tractor 11 and the paper braking mechanism 18. If the print paper 1 is further fed from this condition, the paper does not actually advance as much as it is fed due to the presence of the paper slack. If the printing is carried out in such a condition, the height of the printed characters is compressed or a line spacing becomes unequal.

A similar problem exists when the print paper 1 is loaded or the ink ribbon 2 is replaced. To facilitate loading of the print paper 1 or replacement of the ink ribbon 2, the spacing between the hammer bank 12 and the platen 11 is widened, with the result that the print paper 1 which has been applied with a tension by the friction plate 17 and the paper braking mechanism 18 becomes free from tensive force. When the spacing between the hammer bank 12 and the platen 13 is changed to the original state, the print paper 1 may be slackened.

SUMMARY OF THE INVENTION

The present invention has been made to obviate the aforementioned problems, and accordingly it is an object of the present invention to provide a dot matrix line printer in which the print paper is prevented from slackening at a portion between pin tractors and a paper braking mechanism.

Another object of the present invention is to provide a dot matrix printer in which an existing paper slack is eliminated before the start of printing.

Still another object of the present invention is to prevent the height of the printed characters from being vertically compressed or line spacing from becoming inconsistent.

To achieve the above and other objects, there is provided a dot line printer which has a first motor, paper feeding means operatively connected to the first motor for feeding a print paper in a first direction, a second motor, and tension imparting means operatively connected to the second motor for imparting a tension to the print paper. The tension is imparted to the print paper by pulling the print paper in a third direction that is opposite the first direction. In addition, the printer has a printing mechanism which includes a hammer bank accommodating a plurality of print hammers therein, for carrying out printing on the print paper, and a platen disposed in spaced apart relation to the hammer bank. The hammer bank reciprocally moves in a second direction that is perpendicular to the first direction.

The tension imparting means imparts the tension to the print paper immediately before the feeding of the print paper, by the paper feeding means, is terminated. Accordingly, paper slack is prevented which may otherwise occur if the feeding of print paper is stopped after creating many blank lines.

Alternatively, the tension imparting means imparts the tension to the print paper before the printing is carried out so as to eliminate any existing paper slack.

The above and other objects, features and advantages of the present invention will become more apparent from the following description when taken in conjunction with the accompanying drawings in which preferred embodiments of the present invention are shown by way of illustrative examples.

BRIEF DESCRIPTION OF THE DRAWINGS

FIG. 2 is a perspective view showing an arrangement of a dot matrix line printer according to the preferred embodiments of the present invention;

FIGS. 3A through 3C are timing charts for description of elimination of a paper slack according to the first embodiment of the present invention;

FIGS. 4A through 4C are timing charts for description of elimination of a paper slack according to a second embodiment of the present invention;

FIGS. 5A through 5C are timing charts for description of elimination of a paper slack according to a third embodiment of the present invention;

DESCRIPTION OF THE PREFERRED EMBODIMENTS

Figure 1:
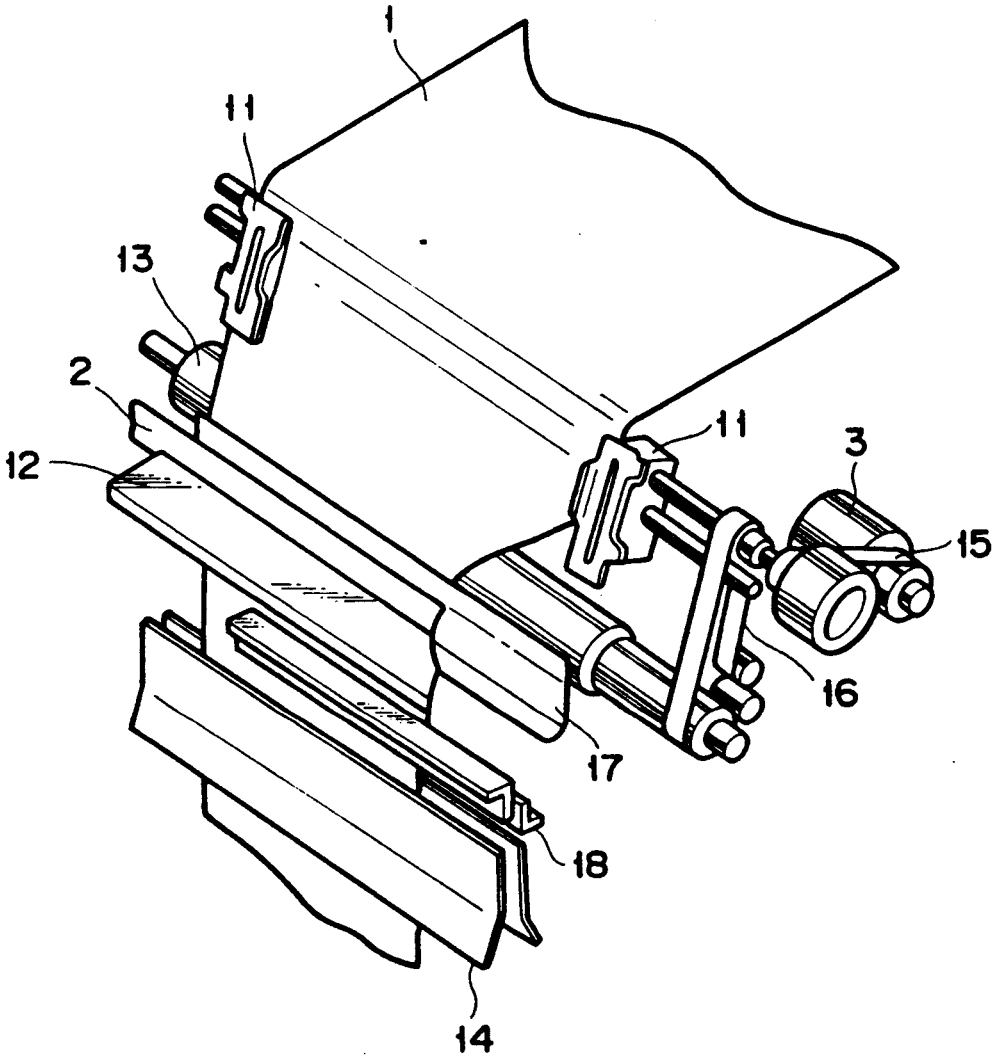
FIG. 1 PRIOR ART
FIG. 1 is a perspective view showing an arrangement of a conventional dot line printer.

A dot matrix line printer according to the present invention is shown in FIG. 2, wherein the same parts or the same components as those shown in FIG. 1 are denoted by the same reference numerals and duplicate description thereof is omitted herein.

The printer of FIG. 2 has a printing mechanism similar to that shown in FIG. 1, which includes a hammer bank 12 and a platen 13 disposed in spaced apart relation to each other with a predetermined spacing therebetween. Beneath the printing mechanism, a tension roller mechanism 20 is provided for imparting a braking force to a print paper 1 so as to impart a tension to the print paper 1 in the portion between the mechanism 20 and the pin tractors 11, 11. The purpose of the tension roller mechanism 20 is similar to the of the paper braking mechanism 18 of the conventional printer.

The tension roller mechanism 20 includes a drive shaft 20*a* and a pinch roller shaft 20*b* arranged in parallel to each other. A plurality of spaced apart drive rollers 23 are fixedly coaxially mounted on the shaft 20*a* to be rotatable therewith and an equal plurality of pinch rollers 24 are rotatably coaxially mounted on the pinch roller shaft 20*b* in positions corresponding to the drive rollers 23. A corresponding drive roller 23 and the pinch roller 24 are in peripheral contact with each other and apply a braking force to the print paper 1 passing between the drive roller 23 and the pinch roller 24.

In this embodiment, there is provided a drive motor 21 in addition to a paper feed motor 3. The platen 13 and the drive shaft 20*a* are operatively connected to the drive motor 21 through a timing belt 22 to rotate the platen 13 and the drive rollers 23. The drive motor 21 is rotated in a reverse direction with respect to the rotational direction of the paper feed motor 3 so as to prevent the print paper 1 from slackening or to eliminate existing paper slack. Specifically, the print paper 1 is frictionally pulled downward by the platen 1 and the drive rollers 23, so that the slack of the print paper 1 which may occur between the pin tractor 11 and the tension roller mechanism 20 if the print paper 1 is stopped after creating many blank lines can be prevented, or existing paper slack can be eliminated.

FIGS. 3A through 3C are timing charts illustrative of prevention of a paper slack according to a first embodiment of the present invention. The first embodiment pertains to paper slack which may occur after creating many blank lines. FIG. 3A is a timing chart of the paper feed motor 3, in which a high level duration t1 indicates an energized state of the motor 3, during which the print paper 1 is continuously fed to create many blank lines, such as in the case of a form feed. FIG. 3B is a timing chart of the drive motor 21, in which a high level duration t2 indicates an energized state of the drive motor 21, during which the motor 21 is rotated reversely with respect to the rotational direction of the paper feed motor 3. The high level duration t2 is not long in duration. Typically, t2 is determined to be equal to or less than 10 milliseconds. FIG. 3C is a timing chart of the print hammers, in which a low level duration t3 indicates a non-printing period whereas high level durations t4 indicate printing periods.

Figure 6:
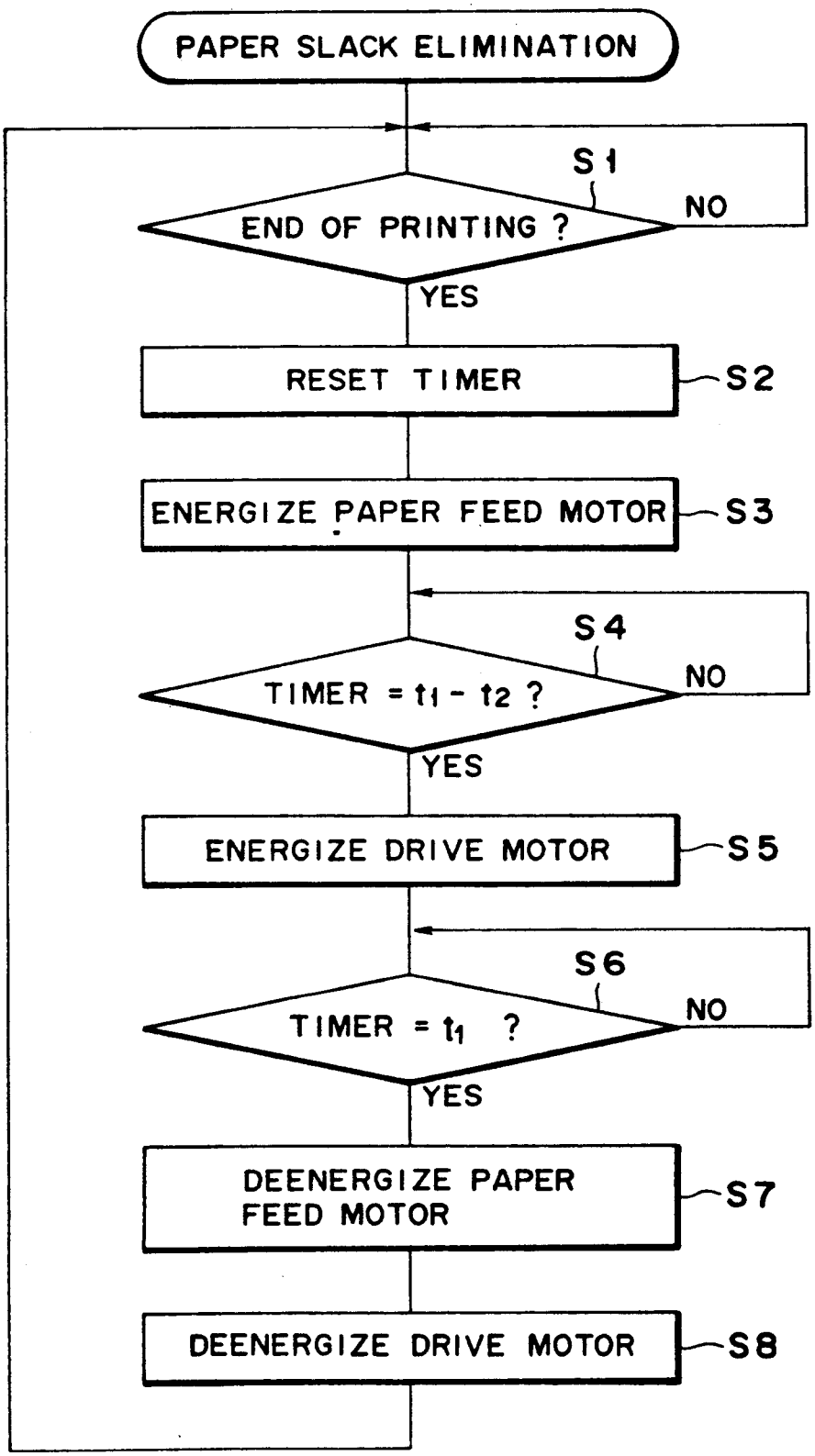
FIG. 6 is a flow chart illustrative of the operation of the first embodiment.

Control of the paper feed motor 3, the drive motor 21, and the print hammers is carried out by a microcomputer 40 in accordance with a program illustrated in FIG. 6 in the form of a flow chart.

In the flow chart of FIG. 6, after the end of printing is confirmed (step S1), a timer (not shown) is reset to start measuring a time (step S2), and concurrently the paper feed motor 3 is energized (step S3). With the energization of the paper feed motor 3, the pin tractors 11 entrain the print paper 1 upwardly. When the timer indicates expiration of a predetermined time (t1-t2), the drive motor 21 is energized (step S5). The drive motor 21 is rotated reversely with respect to the rotational direction of the paper feed motor 3. Therefore, the platen 13 and the tension roller mechanism 20 frictionally pull the print paper 1 downwardly. When the timer indicates expiration of a time t1, the energizations of both the paper feed motor 21 and the drive motor 3 are ceased (steps S7 and S8) and the printing is resumed (step S1).

As described, the print paper 1 is pulled downward for a short period of time immediately before the upward movement of the print paper 1 is stopped to cancel a force of inertia of the print paper 1. Therefore, paper slack does not occur in the portion between the pin tractor 11 and the tension roller mechanism 20 even after many blank lines are created.

FIGS. 4A through 4C are timing charts illustrative of prevention of a paper slack according to a second embodiment of the present invention. The second embodiment is made to lessen a load imposed on the print paper 1. Due to the frictional contacts of the platen 13 and the drive rollers 23 with the print paper 1, an undue load might be imposed on the print paper 1 during the paper feeding. If it is the case, the perforations of the print paper 1 which are engaged with the pin tractors 11, 11 might be torn. To obviate such a problem, the drive motor 21 is rotated in the same direction as the paper feed motor 3 during a predetermined period of time t7 when the print paper 1 is being fed by the paper feed motor 3. Immediately before the paper feeding is ended, the drive motor 21 is rotated in the reverse direction for a duration t2 to thereby prevent the print paper 1 from slackening.

Figure 7:
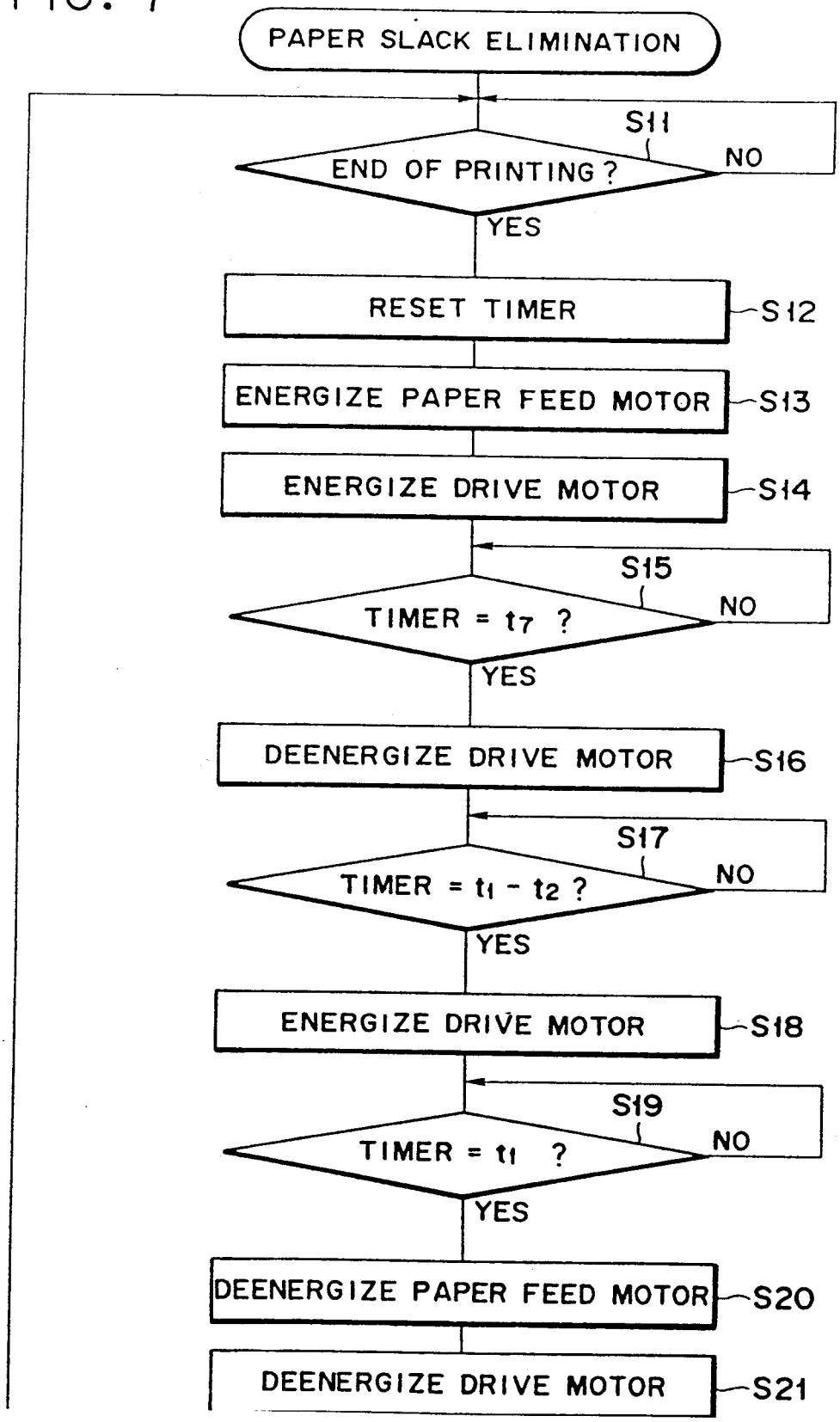
FIG. 7 is a flow chart illustrative of the operation of the second embodiment.

Operation of the second embodiment will be described in detail with reference to the flow chart shown in FIG. 7.

After the end of printing is confirmed (step S11), the timer is reset to start measuring a time (step S12), and concurrently both the paper feed motor 3 and the drive motor 21 are energized (steps S13 and S14 ). With the energization of the paper feed motor 3, the pin tractors 11 entrain the print paper 1 upwardly. The drive motor 21 is energized to rotate in the same direction as the paper feed motor 3. This reduces the frictional resistances of the platen 13 and the drive rollers 23, imparted to the print paper 1. When the timer indicates expiration of a time t7 (step S15), the drive motor 21 is deenergized (step S16). When the timer indicates expiration of time (t1-t2) (step S17), the drive motor 21 is again energized (step S18) but this time it is energized to rotate in a reverse direction. Therefore, the platen 13 and the tension roller mechanism 20 frictionally pull the print paper 1 downwardly. When the timer indicates expiration of a time t1 (step S19), the energizations of both the paper feed motor 3 and the drive motor 21 are ceased (steps S20 and S21) and the printing is resumed (step S11).

FIGS. 5A through 5C are timing charts illustrative of elimination of a paper slack according to a third embodiment of the present invention. The third embodiment is directed to the elimination of paper slack which may occur when the spacing between the hammer bank 12 and the platen 13 is widened.

As indicated in FIG. 5A, a print start command is issued from a central processing unit (not shown) after the manipulation of the platen 13. Thereafter, the drive motor 21 is rotated reversely for a duration of time t2 as indicated in FIG. 5B to pull the print paper 1 downwardly. At this time, the printing operation has not yet been commenced and the paper feed motor 3 has not been energized. The slackened print paper 1 resulting from the manipulation of the platen 13 is pulled downward before the printing operation starts so as to eliminate a slack in the print paper 13. After the paper slack is eliminated, the printing operation is commenced.

Figure 8:
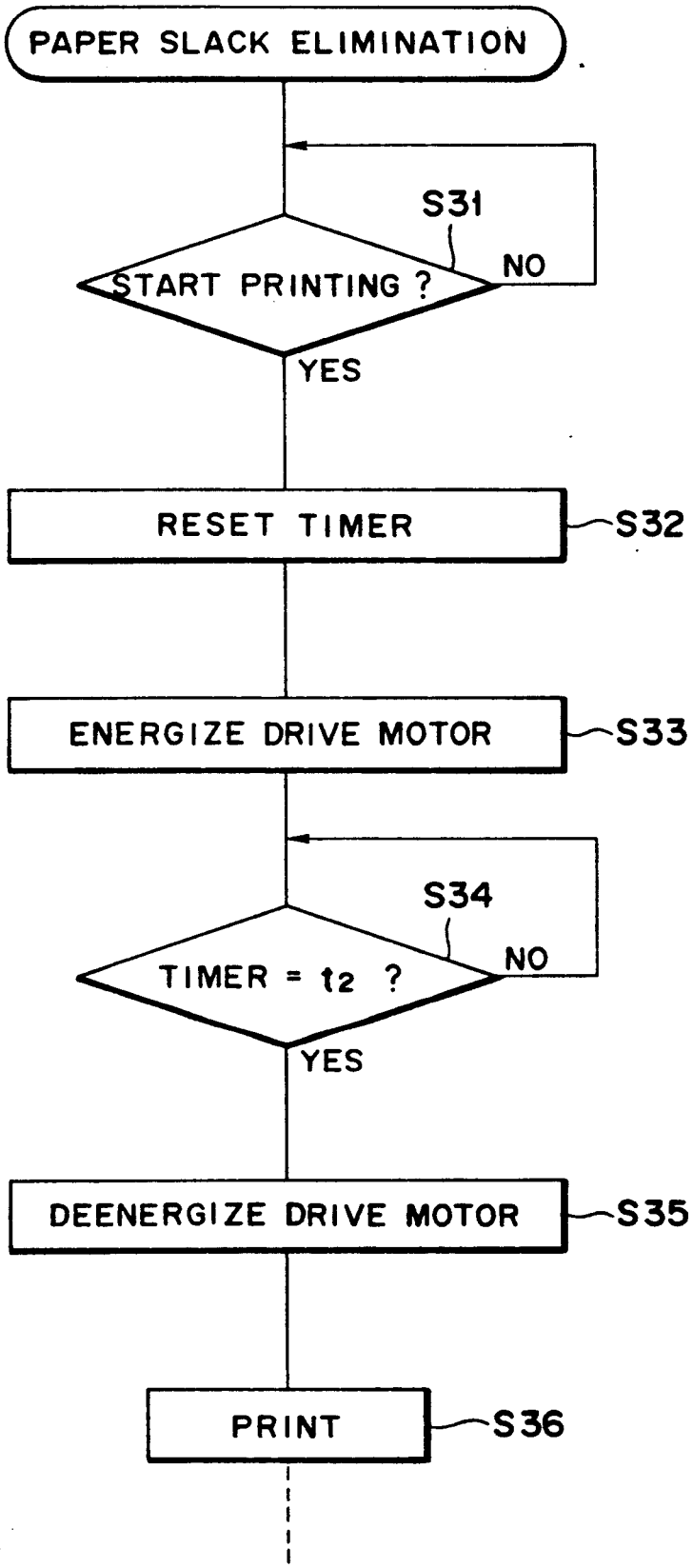
FIG. 8 is a flow chart illustrative of the operation of the third embodiment.

Operation of the third embodiment will be described with reference to the flow chart shown in FIG. 8.

When the print start command is received and the start of the printing is thereby instructed (step S31), the timer is reset (step S32) to measure a time, and concurrently the drive motor 21 is energized to rotate in the direction to pull the print paper 1 downward (step S33). When the timer indicates expiration of time t2 (step S34), the drive motor 21 is deenergized (step S35). Specifically, the drive motor 21 is energized for a duration of time t2 before the printing operation is commenced, during which time the slack of the print paper 1 existing between the pin tractors 11 and the tension roller mechanism 20 is eliminated. Therefore, the height of the printed characters is not compressed and the line spacing does not become inconsistent.

While preferred embodiments of the present invention have been described in detail, those skilled in the art will recognize that there are many possible modifications and variations which may be made to these embodiments while yet retaining the novel features and advantages of this invention. Accordingly, all such modifications and variations are intended to be included within the scope of the appended claims.

What is claimed is:

1. A printer comprising:

a first motor;

a paper feeding device operatively connected to said first motor and positioned so as to feed a print paper in a first direction;

a printing mechanism positioned with respect to said print paper so as to carry out printing on said print paper;

a second motor;

a tension imparting device operatively connected to said second motor and positioned with respect to said print paper so as to impart a tension to said print paper, said tension being imparted to said print paper in a third direction that is opposite said first direction; and a platen disposed in spaced apart relation to said printing mechanism so as to be in frictional contact with said paper, said platen being rotatable about its own axis and operatively coupled to said second motor so as to pull said print paper in said third direction in concert with said tension imparting device.

2. A printer comprising:

a first motor;

a paper feeding device operatively connected to said first motor and positioned so as to feed a print paper in a first direction;

a printing mechanism positioned with respect to said print paper so as to carry out printing on said print paper;

a platen disposed in opposition to said printing mechanism;

a second motor;

a tension imparting device operatively connected to said second motor and positioned with respect to said print paper so as to impart a tension to said print paper, said tension being imparted to said print paper in a third direction that is opposite said first direction;

said tension imparting device comprising a plurality of rollers which are in frictional contact with the print paper and rotated by said second motor; and said platen being operatively connected to said second motor and rotated by said second motor to rotate in a rotational direction that corresponds to a rotational direction in which said plurality of rollers rotate, said platen being in frictional contact with the print paper.

3. A process of advancing paper in a printer which includes a first motor operatively coupled to a paper feeding device, a hammer bank which reciprocates in a second direction, a platen disposed in opposition to said hammer bank and a second motor operatively coupled to a tension imparting device, said process comprising the steps of:

feeding said paper in a first direction;

imparting tension, in a selective manner, to said paper, so as to pull said paper in a third direction which is opposite to said first direction, said imparting step occurring only for a period of time which is immediately before the termination of said feeding step.

4. A process of advancing paper in a printer which includes a first motor operatively coupled to a paper feeding device, a hammer bank which reciprocates in a second direction, a platen disposed in opposition to said hammer bank and a second motor operatively coupled to a tension imparting device and said platen, said process comprising the steps of:

feeding said paper in a first direction;

imparting tension, in a selective manner, to said paper, so as to pull said paper in a third direction which is opposite to said first direction; and rotating said platen in concert with said imparting step.

* * * * *